United States Patent [19]

Hälssig

[11] Patent Number: 4,895,074

[45] Date of Patent: Jan. 23, 1990

[54] IGNITION TRIGGER DEVICE

[75] Inventor: Andreas Hälssig, Denkingen, Fed. Rep. of Germany

[73] Assignee: Gebrüder Junghans GmbH, Schramberg, Fed. Rep. of Germany

[21] Appl. No.: 241,362

[22] Filed: Sep. 7, 1988

[30] Foreign Application Priority Data

Sep. 18, 1987 [DE] Fed. Rep. of Germany ..... 3731447

[51] Int. Cl.[4] ..... F23Q 5/00

[52] U.S. Cl. ..... 102/206; 102/399

[58] Field of Search ..... 102/206, 399; 114/20.1

[56] References Cited

U.S. PATENT DOCUMENTS

| | | | |
|---|---|---|---|
| 820,818 | 5/1906 | Niehoff | 102/399 |
| 1,312,510 | 8/1919 | Baker | 114/20.1 |
| 3,372,253 | 3/1968 | Baker et al. | 102/206 |
| 3,582,672 | 6/1971 | Palmer | 102/206 |
| 4,429,652 | 2/1984 | Stol | 114/20.1 |
| 4,449,211 | 5/1984 | Schmidt et al. | 114/20.1 |

FOREIGN PATENT DOCUMENTS

| | | | |
|---|---|---|---|
| 665139 | 9/1938 | Fed. Rep. of Germany | 114/20.1 |
| 976969 | 9/1964 | Fed. Rep. of Germany | 114/20.1 |
| 3133364 | 3/1983 | Fed. Rep. of Germany . | |
| 3414841 | 10/1985 | Fed. Rep. of Germany . | |
| 404006 | 1/1946 | Italy | 114/20.1 |

*Primary Examiner*—Deborah L. Kyle
*Assistant Examiner*—Stephen Johnson
*Attorney, Agent, or Firm*—Burns, Doane, Swecker & Mathis

[57] ABSTRACT

In an ignition trigger device for an underwater projectile, a sensor that is connected with electronic means is provided. The sensor is equipped with water outlet openings, and consists of a network of individual lines or contact paths exposed to the entry and exit of water into and out of the underwater projectile, respectively.

9 Claims, 1 Drawing Sheet

IGNITION TRIGGER DEVICE

BACKGROUND OF THE INVENTION

The invention relates to an ignition trigger device for an underwater projectile.

In a known ignition trigger according to DE-OS No. 31 33 364 a pressure transducer is loaded by a spring so that with an adequate velocity of the projectile underwater, a switch is being kept open by dynamic pressure acting against the spring force. Only when the surface of the water is breached, is the switch closed, thereby triggering the ignition. The point in time of the switch closing in this ignition triggering device depends on the spring characteristic, which limits possible uses of the device to the extent that it is not possible to use the impact on the target as the switching criterion, if it is designed to ignite upon leaving the water. The response sensitivity of the ignition trigger device according to DE-OS No. 31 33 364 depends on the spring built into it and therefore may only be set relatively coarsely and in practice cannot be subsequently adjusted. This ignition trigger device also has the further disadvantage that sealing problems may occur, because on the one hand the pressure transducer must be mobile relative to the head, and on the other, it must be well sealed against said head.

In an ignition trigger device according to DE-OS No. 34 14 841 these deficiencies are eliminated. In that device, a piezo-ceramic disk equipped with electric contacts is disposed in the projectile head. The disk is rigidly supported on one of its sides, and its other side rests against a pressure transducer body supported in the opening of the head.

In this manner, the dynamic pressure is acting on the piezo-ceramic disk. Any variation of the dynamic pressure results in a corresponding stress or potential variation of the piezo-ceramic disk, which may be processed in an electronic evaluating circuit in a manner such that the variation in the potential may be used as a switching criterion. It is further possible with the ignition trigger device of DE-OS No. 34 14 841 to employ the exit from or entry into the water, together with the impact of the projectile, as the switching criterion for ignition. The disadvantage of this known ignition trigger device is that a certain dynamic pressure must act on the piezo-ceramic disk in order for it to carry out the necessary functions.

SUMMARY OF THE INVENTION

It is the object of the present invention provide an ignition trigger device for an underwater projectile, which facilitates adaptation to different uses and assures satisfactory underwater operation entirely without dynamic pressure.

According to the invention, this object is attained in the case of an ignition trigger device by providing a sensor that is connected with electronic means. The sensor is equipped with water outlet openings, and consists of a network of individual lines or contact paths exposed to the entry and exit of water into and out of the underwater projectile, respectively. The individual lines or contact paths may be insulated relative to each other by air or by a plastic, and enter into contact with each other only when cross-linked by water, this contact being evaluated as a function of the area of the electronic device wetted by water. The network of individual lines or contact paths of the sensor may be spaced apart at a distance that prevents the formation of a liquid film between the individual lines and contact paths in air.

This ignition trigger device, equipped with a so-called cross-linking sensor, has the advantage that its underwater operation is assured without the occurrence of dynamic pressure.

As mentioned earlier, the individual lines or contact paths are insulated with respect to one another by air or by a plastic. If water enters the underwater projectile, the air spaces between the individual lines or contact paths are filled with water, which produces the corresponding short circuits. The latter are evaluated, whereby it may be determined for example whether the sensor is submerged in water completely or in part only. If there is a rapid exit of the projectile from the water, the water droplets are blown from the network by the flow of air alone and the short circuits are eliminated. As this process takes place rapidly, the exit from the water may be determined accurately. The network consisting of the individual lines or contact paths is actuated by means of an appropriate electronic device, for example a microprocessor. One use of the sensor might be the release of safety elements and the actuation of the fuse detonation of the underwater projectile. The point in time at which actuation of the desired functions will occur may be predetermined. For example, actuation might take place only when the entire network of the sensor is cross-linked by water. But the function might also be actuated when the network of the sensor is only filled partially with water; for example, one-half or 30% of the total surface area.

When the underwater projectile equipped with the trigger device according to the invention is fired and impacts an underwater target, detonation is actuated by an additional impact sensor. If, however, no underwater target is impacted and the projectile leaves the water, the ignition trigger is activated whereby, for example, after a complete or partial elimination of the cross-linking of the sensor within a predetermined period of time the underwater projectile is self-destructed. The evaluation of the cross-linking of the sensor, the monitoring of time and the self-destruction of the projectile is determined by subsequent electronic means.

On the other hand, a function may be associated with the trigger device, whereby after the underwater projectile has exited a certain distance from the surface of the water such that the complete or partial elimination of the cross-linking of the sensor has occurred, the fuse is actuated thereby making it possible to impact a target located above the water.

BRIEF DESCRIPTION OF THE DRAWINGS

Other objects and advantages of the present invention will become apparent from the following detailed description of preferred embodiments as described in conjunction with the accompanying drawings in which.

DETAILED DESCRIPTION OF THE INVENTION

Figure 1:
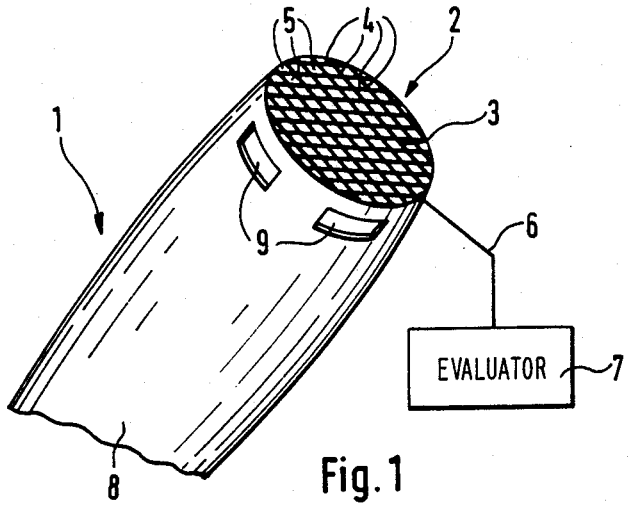
FIG. 1 shows a preferred embodiment of the ignition trigger device of the present invention in a partial schematic view.

In the partial schematic representation of FIG. 1, an ignition trigger device 1 is shown in the form of a cylinder, with the device including a sensor head on top. The sensor 2 consists of a network 3 of spaced apart individual lines or contact paths 4, insulated from each other by air or by a plastic. The network extends across a water inlet of a body or jacket 8 and thus defines a network surface area lying in a water flow path defined by that inlet and an outlet 9. For example, the horizontal lines 4 of FIG. 1 are located below the vertical lines 4 such that the contact points between the horizontal and the vertical lines are electrically insulated from one another. The individual lines or contact paths 4 are connected by means of a line 6 with an appropriate electronic device 7 for the actuation and evaluation of the ignition trigger device 1. Below the sensor 2 mounted on the frontal side, a plurality of the water outlet openings 9 are located in the jacket surface 8 of the trigger device 1.

The function of the ignition trigger device 1 is to determine the entry or exit of water rapidly and accurately by means of the built-in sensor.

The sensor is actuated by means of a suitable electronic device, which may be equipped with a microprocessor. In the embodiment shown herein the sensor is used for the release of safety elements and for the activation of a desired function such as fuse detonation. The sensor is a cross-linking sensor constructed of individual lines insulated with respect to one another. If water enters the sensor, the air spaces between the individual lines or contact paths 4 are filled with water. The film of water lying over the individual lines 4 causes a short circuit which is evaluated by the electronic device. A determination is made simultaneously as to the surface area of the sensor which is cross-linked by water. In the simplest case, for example, each of the horizontal lines and each of the vertical lines in the FIG. 1 sensor could be individually connected to the electronic device 7, so that each such line could be individually queried by the electronic device. If the individual air spaces 5 of the network become filled with water, electrical contact is created between the horizontal and the vertical lines, and this electrical contact is then detected by the electronic device 7. From this determination it can then be ascertained whether the ignition trigger device 1 with its sensor is located entirely or only partially in the water. In the case of a rapid exit of an ignition trigger device 1 included on an underwater projectile from the water, the flow of air blows the water droplets or the film of water from the network whereby the short circuit between the individual lines 4 is eliminated.

Figure 2:
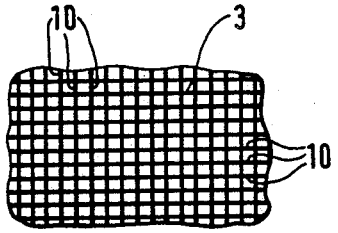
FIG. 2 shows a partial view of the sensor network in accordance with one embodiment of the ignition trigger device of the present invention.
Figure 3:
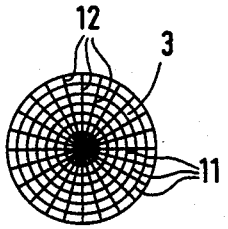
FIG. 3 shows a further partial view of the sensor network in accordance with another embodiment of the ignition trigger device of the present invention.
Figure 4:
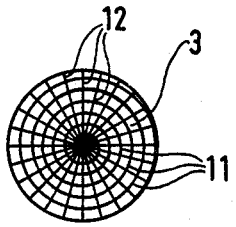
FIG. 4 shows a further partial view of the sensor network in accordance with yet another embodiment of the ignition trigger device of the present invention.

In FIGS. 2, 3 and 4, different networks of the sensor 2, are shown schematically. Thus, the network of the sensor 2 according to FIG. 2 may be constructed of individual lines 10 located at right angles to each other. According to FIG. 3 the network of the sensor 2 may consist of individual lines 11 located concentrically relative to each other and connected by individual radial lines or stays 12 with each other. Similarly, the individual lines or contact paths may also be located helically with radial stays as shown in FIG. 4.

The network of the sensor 2 according to FIG. 1 consists of individual lines 4 located at angles of more or less than 90° relative to each other. The cross-linking distance between the individual lines shown in FIGS. 1 to 4 are predetermined so that upon the emergence of the underwater projectile from the surface of the water the film of water is released from between the individual lines and the existing short circuits are eliminated. The separation of the water droplets or the film of water from the network 3 of the sensor 2 should preferably take place even if the sensor is in the air and is not exposed to velocity.

In this manner, the activation of a sensor of an ignition trigger device 1 for an underwater projectile when the sensor 2 is exposed to rain is prevented. In this case the falling rain drops will pass through the air gap 5 between the individual lines 4, 10, 11 and 12 and will not provide a cross-linking of a large surface area of the network of individual lines or contact paths. Rather, the water exits through the water outlet openings 9 in the jacket surface 8 of the ignition trigger device 1.

It will be appreciated by those of ordinary skill in the art that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. An underwater triggering device comprising a body having a water inlet and a water outlet defining a water flow path, a sensor arranged in said water flow path for detecting the presence of water therein, said sensor including a network of electrically charged electrical contact paths forming a surface area, said electrically charged contact paths being electrically charged in the absence of water in said water flow path and being normally electrically insulated from one another, said electrically charged contact paths arranged to be placed into electrical connection with one another in response to being cross-linked by water in said water flow path, and electronic means electrically connected to said network for evaluating the extent of said network surface are cross-linked by water.

2. An ignition trigger device according to claim 1, wherein the individual contact paths forming the network are insulated with respect to one another by air.

3. An ignition trigger device according to claim 1, wherein the individual contact paths forming the network are insulated with respect to one another by a plastic.

4. An ignition trigger device according to claim 1, wherein the individual contact paths forming the network of the sensor are spaced apart from each other at a distance sufficient to prevent formation of a liquid film between the individual contact paths in the air.

5. An ignition trigger device according to claim 1, wherein the individual contact paths are located at right angles to each other in the network.

6. An ignition trigger device according to claim 6, wherein the individual contact paths are located in the network at angles of about 90° relative to each other.

7. An ignition trigger device according to claim 4, wherein the individual contact paths are located in the network concentrically with radial stays.

8. An ignition trigger device according to claim 4, wherein the individual contact paths are located in the network helically with radial stays.

9. An ignition trigger device according to claim 1, wherein said water flow path includes at least one lateral water outlet formed in said body behind said network.

* * * * *